United States Patent [19]

van Donk et al.

[11] 4,212,330

[45] Jul. 15, 1980

[54] REED BAULK UNIT

[75] Inventors: Cornelis van Donk, Mortel; Hubert P. van Mullekom, Deurne, both of Netherlands

[73] Assignee: Rüti-Te Strake B. V., Deurne, Netherlands

[21] Appl. No.: 939,709

[22] Filed: Sep. 5, 1978

[51] Int. Cl.[2] ..... D03D 47/30

[52] U.S. Cl. ..... 139/435

[58] Field of Search ..... 139/435, 452, 188 R

[56] References Cited

U.S. PATENT DOCUMENTS

| | | | |
|---|---|---|---|
| 3,181,571 | 5/1965 | Scheffel | 139/435 |
| 3,229,725 | 1/1966 | Saito | 139/435 |
| 3,901,286 | 8/1975 | Vermeulen et al. | 139/435 |
| 4,031,926 | 6/1977 | Zollinger et al. | 139/435 |
| 4,143,681 | 3/1979 | Kuda et al. | 139/435 |

FOREIGN PATENT DOCUMENTS

| | | | |
|---|---|---|---|
| 29651 | of 1964 | Japan | 139/435 |

*Primary Examiner*—Henry Jaudon

*Attorney, Agent, or Firm*—Marshall & Yeasting

[57] ABSTRACT

A reed baulk unit for a pneumatic weaving machine comprising a series of reed blades held in a groove in a head portion of said unit and at least one blowing nozzle housing located close to said reed blades, said blowing nozzle housing being fed from a pressurized air container through valve means which are mounted on the reed baulk and adapted to be actuated by a control shaft supported by the reed baulk, said reed baulk having an arm portion by means of which it is fixed to rocking trunnions which are rotatably mounted in the weaving machine, said reed baulk unit being characterized in that the reed baulk is formed of an extruded hollow profile, a longitudinal hollow space of which serves as said pressurized air container communicating, through an opening in the wall of the reed baulk profile, with blowing nozzle housing located on the outer side of the reed baulk profile, and control valves for said blowing nozzle housing accommodated by the blowing nozzle housing, while said control shaft is supported in a substantially semi-cylindrical recess in a portion of the reed baulk profile projecting outwardly adjacent the blowing nozzle housing.

7 Claims, 5 Drawing Figures

REED BAULK UNIT

This invention relates to pneumatic weaving machines.

In pneumatic weaving machines, in which the conveyance of the wefts is effected by means of gas jets, or more particularly air jets produced by blowing nozzles, two main functions can be distinguished, viz., the preparation of the weft lengths to be transported one after the other through the shed, and the pneumatic conveyance system, by means of which the measured weft threads are transported from one side of the weaving machine through the shed towards the other side.

The invention relates to the second main function.

The weft conveyance system of a modern pneumatic weaving machine comprises a main blowing nozzle located at one end of the shed, and a number of auxiliary blowing nozzles and a tensioning nozzle distributed across the weaving width, said auxiliary blowing nozzles being supported by the lay or reed baulk are are periodically fed from a pressurized gas container through valves and corresponding to the progress of the weft inserting phase. The main blowing nozzle, which may also be periodically fed from a pressurized gas container, is fixed to the reed baulk, so that is takes part in the reciprocating movement of the reed.

As an example of a well known embodiment of such a weaving machine reference is made to U.S. Pat. No. 3,229,725. With this machine the pressurized gas container is constituted by the hollow space of the reed baulk which is formed as a rectangular sheath, in which space the control valves for the auxiliary blowing nozzles and the shaft for actuating these valves are accommodated as well.

The air consumption with such weaving machines is an important factor; as a result of the gradually decreasing cross-section of the weft transporting channel confined by the reed blades the air consumption has been substantially reduced but on the other hand it is a factor of great importance, which to a great extent determines the efficiency of the pneumatic weaving process. It has also been found that the shape of the pressure pulses connected with the successive gas jets or air jets (hereinafter called air jets) influences the efficiency of the air consumption. The well known embodiment, in which the pressurized air container, the blowing nozzle, the control valves and the control shaft are mounted for taking part in the motion of the reed baulk, influences the pulse shape.

An important factor in the assembling of such weaving machines is connected with the circumstance that the location and also the number of the auxiliary blowing nozzles to be used should be adaptable to various weaving widths in an efficient manner. In this connection the well-known embodiment, in which the blowing nozzles, valves and control means are arranged within the reed baulk, has great disadvantages, while the reed baulk has to be necessarily divided longitudinally into parts.

The invention aims at overcoming or reducing the above mentioned disadvantages of prior pneumatic weaving machines and more particularly with respect to that section of such machines, in which the weft transportation takes place, and proposes measures through which it will be easier for such machines to come up to the basic modern requirements.

For this purpose the invention provides a reed baulk unit for a pneumatic weaving machine comprising a series of reed blades held in a groove in a head portion of said unit and at least one blowing nozzle housing located close to said reed blades, said blowing nozzle housing being fed from a pressurized air container through valve means which are mounted on the reed baulk and adapted to be actuated by a control shaft supported by the reed baulk, said reed baulk having an arm portion by means of which it is fixed to rocking trunnions which are rotatably mounted in the weaving machine, said reed baulk unit being characterized in that the reed baulk is formed of an extruded hollow profile, a longitudinal hollow space of which serves as said pressurized air container communicating, through an opening in the wall of the reed baulk profile, with blowing nozzle housing located on the outer side of the reed baulk profile, and control values for said blowing nozzle housing accommodated by the blowing nozzle housing, while said control shaft is supported in a substantially semi-cylindrical recess in a portion of the reed baulk profile projecting outwardly adjacent the blowing nozzle housing.

Due to the fact that the blowing nozzles and the valves are assembled to individually units, which may be mounted on the outer side of the reed baulk profile, the reed baulk unit according to the invention is easily adapted to various weaving widths. The hollow space of the reed baulk profile serving as a pressurized air container may be, at any location, i.e., a location where a combined blowing nozzle-control valve unit is desired, whereas the reed baulk profile may be extruded or cut respectively to any desired length corresponding to the desired weaving width, which means an efficient manufacture of the reed baulk.

It will be appreciated that such a reed baulk together with the combined blowing nozzle-control valve housings adapted to it and the control shaft to be supported in a semi-cylindrical recess of the projecting portion may be assembled in a very compact and relatively light weight unit. The projecting portion with its semi-cylindrical recess may be locally removed, if desired, so as to create space for the rotation of cams or similar control means to be mounted on to said control shaft.

In a preferred embodiment the reed baulk has a hollow profile having a longitudinally constant cross-section, said profile having at its longitudinal edge turned away from the reed a substantially semi-cylindrical recess extending along the entire length of the profile and adapted to accommodate a rocking shaft.

According to a further feature of the invention the longitudinal hollow space of the reed baulk profile serving as a pressurized air container is closed at the end by plates which are integrally formed with arms serving for the rocking motion of the reed, in which plates there are connecting means for flexible conduits for the pressurized air supply.

The invention also relates to a reed baulk adapted for the assembly of the above described reed baulk unit, said reed baulk being characterized by an extruded profile, comprising a bending resistant section having a longitudinal hollow space closed on all sides and a second section which is connected to said first section by means of a reduced portion and hence may be bent relative to said first profile section, said two sections confining together the groove for accommodating the reed blades, a side wall portion of the bending resistant profile section adjacent the blade accommodating groove being provided with a longitudinally extending projection having a substantially semi-cylindrical recess.

Other devices required for performing the main function in such as a thead clamp determining the start of the weft insertion and a cutting member for cutting the measured weft thead lengths are also mounted as parts of the reed baulk unit. The reed baulk unit assembled in this manner is simply tested as an independent unit with respect to the weft inserting function to be performed by it, and can be easily mounted in the frame of the weaving machine which carries the weft thread preparing mechanism.

A particular advantage of the reed baulk formed as an extruded profile is that the walls of it do not require any finishing or dressing work at locations, where the further machine parts, such as rocking shaft trunnions, a control shaft for actuating blowing nozzle-valves, and the combined blowing nozzle-control valve housings have to be mounted.

The invention will hereinafter further explained by way of example with reference to the accompanying drawings, in which.

Figure 1:
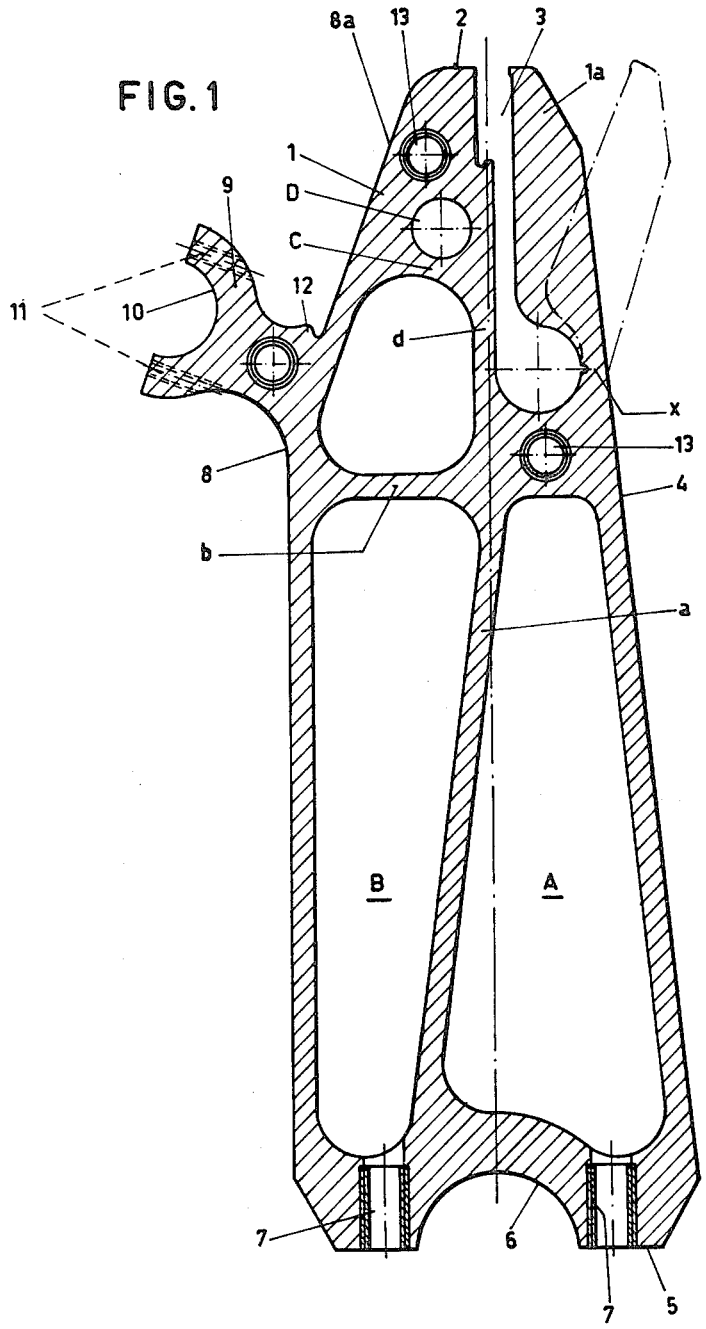
FIG. 1 shows a cross-section of a reed baulk profile adapted to the assembly of the reed baulk unit.

The reed baulk profile shown in FIG. 1 for a pneumatic weaving machine shown partially at 60, has a substantially trapezoid cross-section and is formed by extrusion from aluminium; its hollow space is divided by partitions a, b, c and d in a number of sections A, B, C and D. Sections A and B extend across the extrusion to make it light weight. In the head portion 1 there is a longitudinal groove 3, opening into upper parallel side 2, which groove is to accommodate a reed. The groove 3 at its bottom side widens toward an oblique side 4 of the profile, as a result of which a reduction in cross-section is created at x; due to this the head portion 1*a* on the right side is easily drawn toward the bending resistant head portion 1 on the left side by turning the fastening valves (not shown) for the reed, without resulting in deflection of the reed baulk profile.

In the lower side of the reed baulk 5 a semi-circular recess 6 is formed which extends along the entire length of the profile and is adapted to accommodate rocking trunnions to be mounted at the ends of the reed baulk. After the profile has been cut to the desired length, bores with threaded bushes 7 are provided at the profile ends for securing fastening clips for the rocking trunnions.

A second oblique side 8 of the profile shows a bend, at which there is a projecting portion 9 having a semi-cylindrical recess 10. The semi-cylindrical recess 10 serves, as will be explained hereinafter, to support a control shaft, the bearings for which may be secured by means of fastening clips and fastening screws. For this purpose threaded bores 11 are provided into the projecting portion 9 at the desired locations.

The section C of the hollow space of the profile serves, as will be explained hereinafter, as a container for pressurized air, whereas the section D serves as an auxiliary container for pressurized air.

Due to the reed baulk profile being manufactured by extrusion, the semi-cylindrical recesses 6 and 10 may be used to support the above mentioned rocking trunnions and control shaft without any further finishing or dressing work. This also applies for the outer wall surface 8*a*, which may be used as mounting surface for the combined control valve-auxiliary blowing nozzle housing without any further finishing work. At 12 a locating ledge is indicated, which serves as a seat for the combined control valve-auxiliary blowing nozzle housing.

The extrusion of the described reed baulk profile is carried out with the head portion 1*a* on the right side taking the position indicated by dotted lines. As mentioned before, the head portion 1*a* may be easily bent inwardly at the zone x of reduced wall thickness when the reed is to be assembled. In the ends of the reed baulk profile cut to the desired length, threaded bores 13 are provided for screws for securing an end plate, by means of which the sections C and D are closed.

Figure 2:
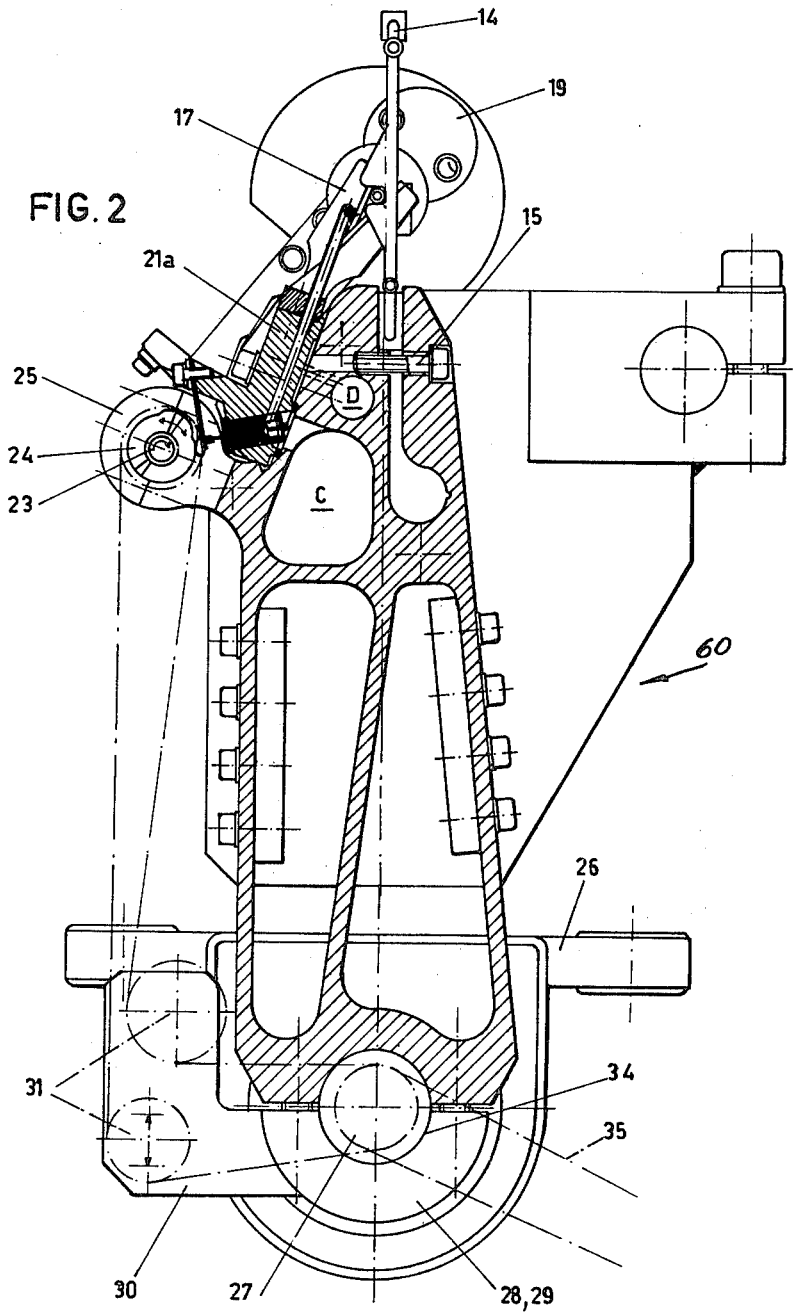
FIG. 2 is a cross-section of the complete reed baulk unit.
Figure 3A:
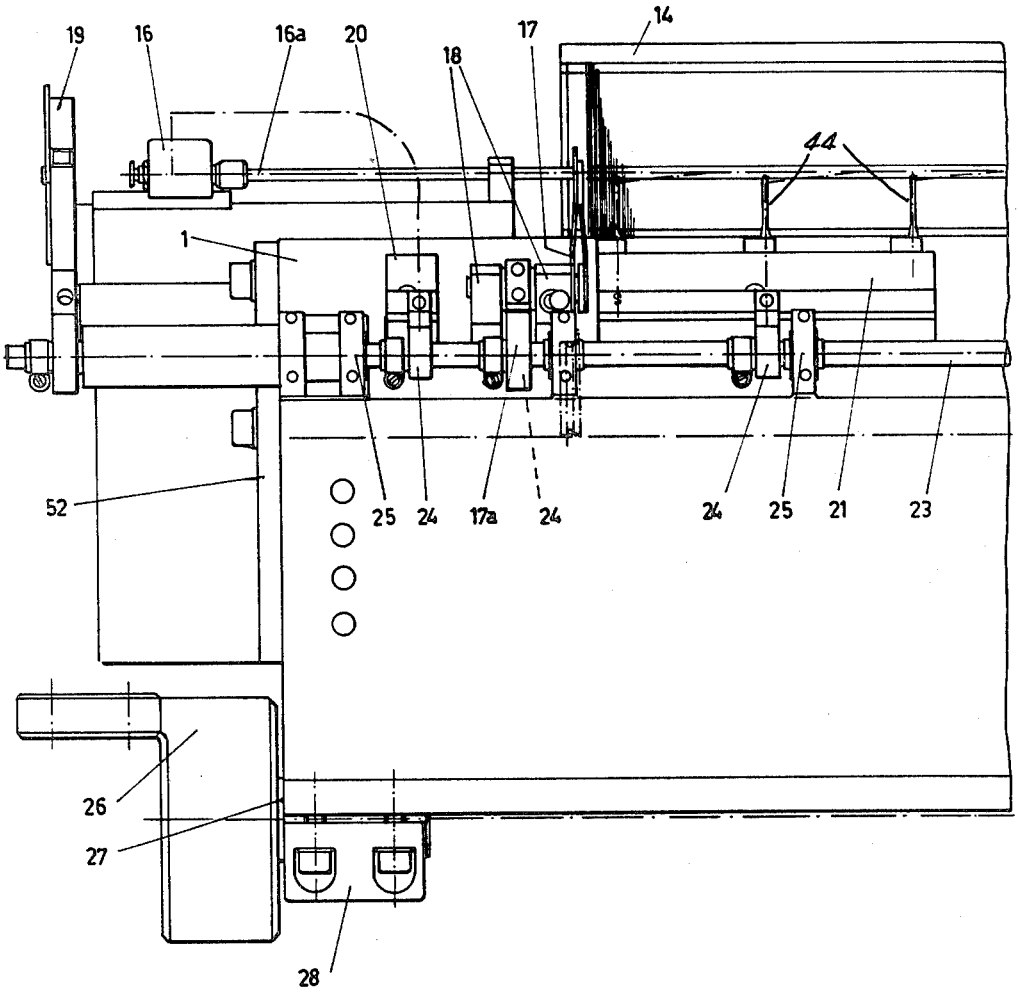
FIGS. 3A and 3B are an elevation of the reed baulk unit, as seen from the left in FIG. 2.
Figure 3B:
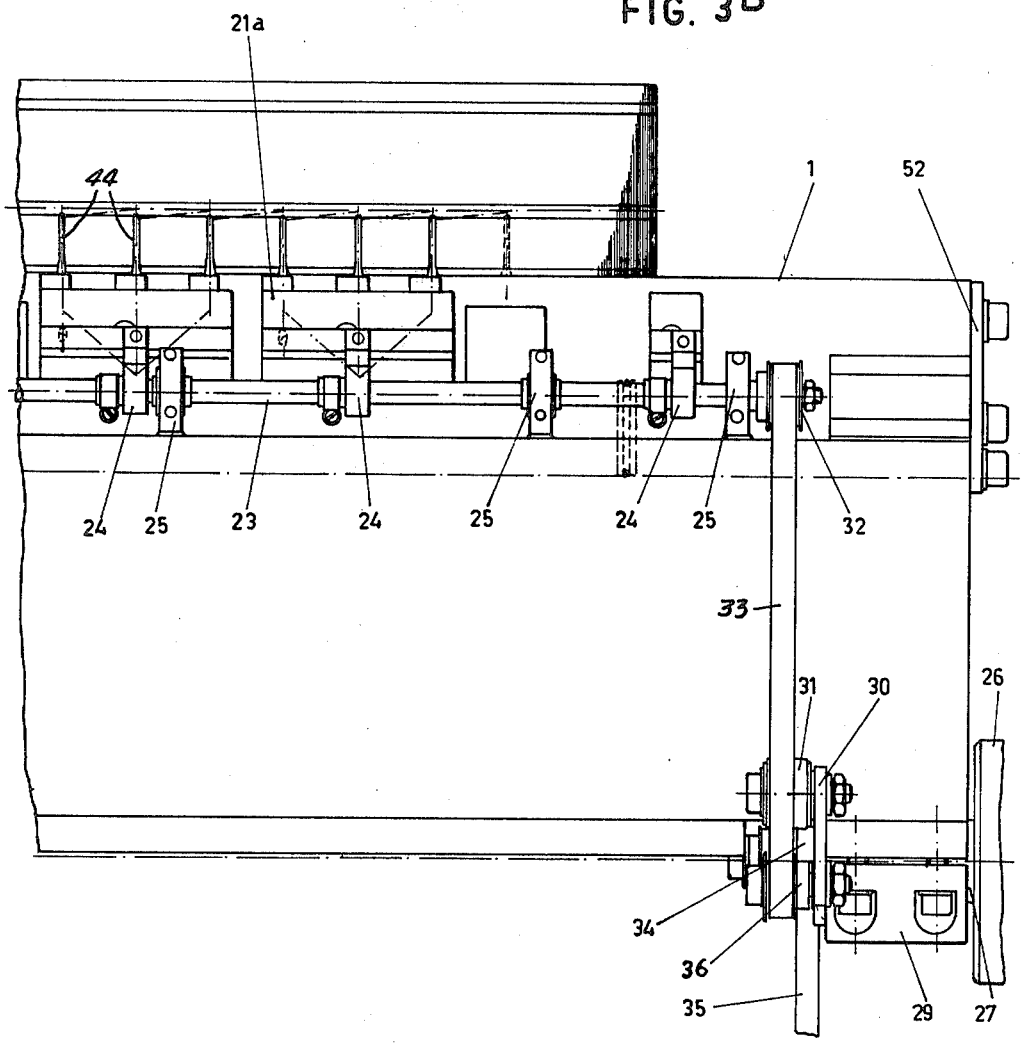

In the complete reed baulk unit of FIGS. 2 and 3A, 3B the following devices and parts are secured to the reed baulk:

The reed 14 which is secured in the groove 3 by means of screws 15;

The main blowing nozzle 16 with its mixing tube 16*a* which is secured to a part of the reed baulk extending laterally beyond the reed; as described above, U.S. Pat. No. 3,229,725 shows the weft conveyance system of a modern pneumatic weaving machine comprises a main blowing nozzle located at one end of the shed, and a number of auxiliary blowing nozzles and a tensioning nozzle distributed across the weaving width, said auxiliary blowing nozzles being supported by the lay or reed baulk and are periodically fed from a pressurized gas container through valves and corresponding to the progress of the weft inserting phase. The main blowing nozzle, which may also be periodically fed from a pressurized gas container, is fixed to the reed baulk, so that is takes part in the reciprocating movement of the reed.

The cutting member 17, mounted between the outlet end of the mixing tube 16*a* of the main nozzle 16 and the inlet end of the transportation channel confined by the reed blades, the actuating cam 17*a* of said member being rotatably mounted between a forked part 18, which is secured to the mounting surface 8*a* FIG. 1 of the reed baulk profile at a suitable location;

The thread clamp 19 which is secured at a location adjacent the inlet end of the main nozzle 16;

The control valve 20 for the main nozzle secured to the mounting surface 8*a* (FIG. 1) of the reed baulk at a location adjacent the end of the reed baulk;

The combined control valve-auxiliary blowing nozzle housings 21 and 21*a* which may each contain a group of, e.g., three auxiliary blowing nozzles 44 and are secured on to the mounting surface 8*a* of the reed baulk while bearing on the locating ledge 12 at locations between the end of the reed baulk;

The control shaft 23 with its control cams 24 (operates spring arms 49 and buttons 51 hereinafter described), which is supported in the semi-cylindrical recess 10 by means of bearings and fastening clips 25, the outwardly projecting portion 9 being locally cut away or otherwise removed so as to create space for the rotation of the control cams 24;

The brackets 26 and the rocking trunnions 27 rotatably mounted therein, the ends of the trunnions 27 extending beyond the brackets 26 being secured in the cylindrical recess 6 of the reed baulk profile by means of semi-cylindrical members 28 and 29 respectively;

An arm 30 secured to the member 29 at the right end of the reed baulk (as seen in FIG. 3B), said arm carrying guide roller 31 for guiding a driving belt 33 running on a pulley 32; and also carrying a driving roller 36 for driving the belt 33;

A roller 34, which is similar to rollers 31 and 36, is rotatably mounted coaxially at the free end of the rocking trunnion on the right side in FIG. 3B, said roller 34 being driven, through a drive belt 35, by a drive shaft mounted in the frame of weaving machine. The roller 34 drives the roller 36 which in turn drives the belt 33 driving the cam shaft 23.

Figure 4:
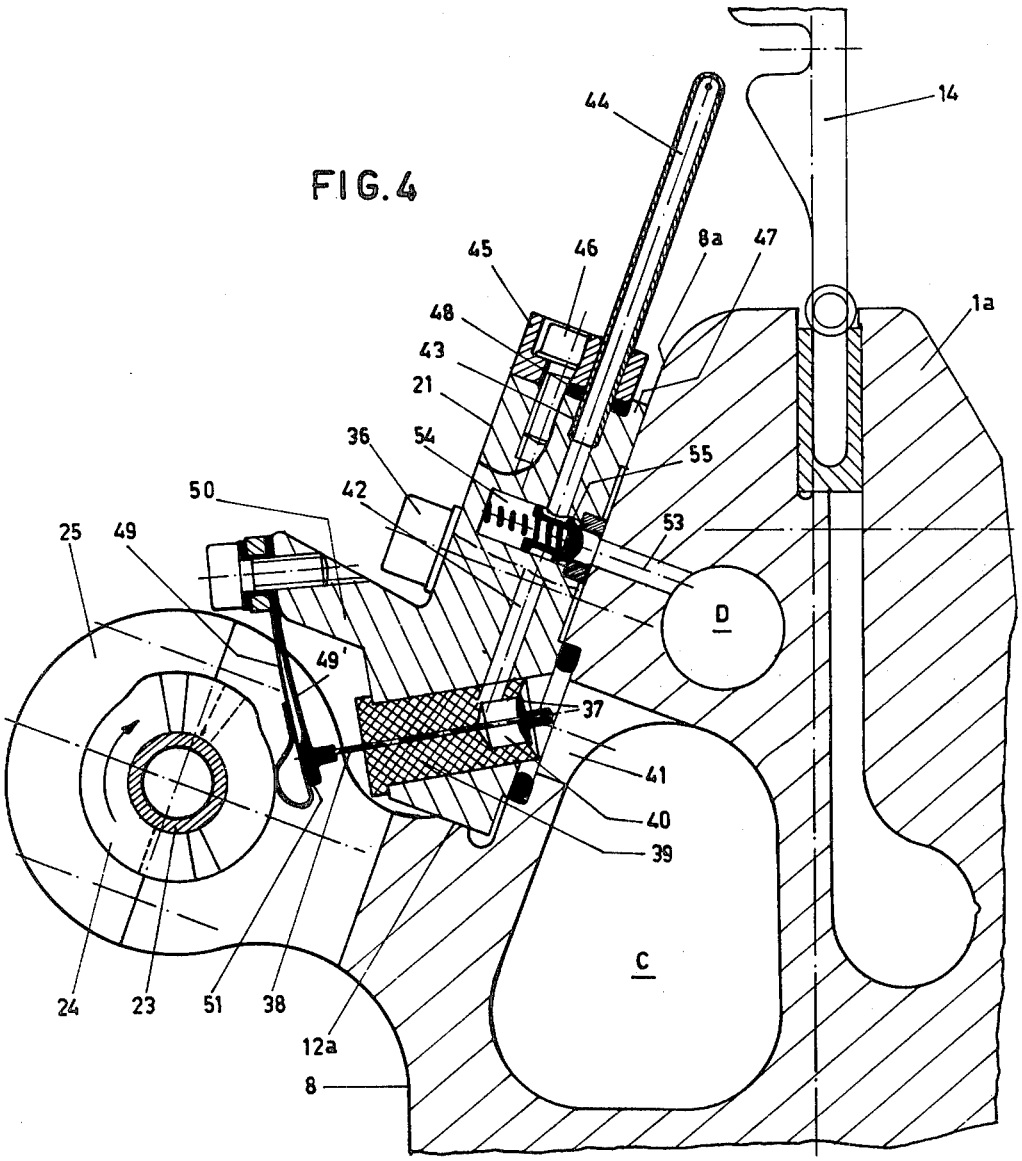
FIG. 4 is a cross-section of a part of the reed baulk unit of FIG. 2, adjacent the location of a combined control valve-auxiliary blowing nozzle housing.

The combined control valve-auxiliary blowing nozzle housing 21 or 21*a* respectively is of a special construction as compared with the constructions known so far. This housing consists of a block, extruded from a light weight metal, more particularly aluminium, which block is secured to the mounting surface 8*a* of the reed baulk profile by means of one or more screws 36 (FIG. 4). The valve member comprises a mushroom-shaped element 37 secured to a needle thin valve stem 38, the latter being guided in a bore in an insert 39 of hard rubber. The valve chamber 40 is constituted by a local widening of the guide bore for the valve stem 38 and the conical bevel of said widened bore forms a seat for the spherical end face of the valve element 37. The valve element 37 constitutes the closable connection between the valve chamber 40 and the section C of the hollow space of the reed baulk profile serving as a pressurized air container and is connected to said valve chamber 40 by means of a bore 41 in the wall 8*a* of the reed baulk profile.

A number of passages 42 formed by bores emanate from the valve chamber 40 and (through additional connecting passages if necessary) lead to a number of connecting facilities 43 for the auxiliary blowing nozzles 44 in the upper wall of the block-shaped control valve housing 21 (21*a*). There are as many passages 42 (and additional connecting passages, if any) as there are connecting facilities 43 for the auxiliary blowing nozzles 44 in the concerning block. The auxiliary blowing nozzles 44 are of a well-known construction and essentially consist of a thin tube which is closed at its free end and has in its side wall adjacent the closed end an outlet opening for a transporting air jet. The auxiliary blowing nozzles 44 are secured by cement, in a rectangular fastening flange 45, which may be secured on the upper surface of the control valve block 21 (21*a*) by means of a fastening screw 46 positioned eccentrically with respect to the auxiliary blowing nozzle 44. The fastening flange 45 bears on a locating ledge 47 extending from the upper surface of the control valve block 21 (21*a*). The auxiliary blowing nozzle 44 extends with its open end downwardly beyond the fastening flange and is surrounded by a sealing ring 48 accommodated in an annular chamber in the lower surface of the fastening flange 45. The downwardly projecting end of the auxiliary blowing nozzle 44 extends into the connecting opening 43, the sealing ring 48 taking care of the required air tightness. In this manner a quick assembly and change of the individual auxiliary blowing nozzle 44 can be achieved.

As a transmitting element between the control valve and the associated control cam 24 there is a spring arm 49 which is secured to an outwardly projecting rib 50 of the control valve block 21 (21*a*) and bears on to a button 51 on the needle thin valve stem 38 at a location between its attachment to the block and the pressing point of the cam; the button may be formed integrally with the valve element 37. The valve stem 38 is kept in spring contact with the spring arm 49 by means of a counteracting auxiliary spring arm 49′ engaging underneath the button 51.

There is a transmitting element of similar nature between the control cam and the control valve for the main blowing nozzle and the tensioning nozzle.

As mentioned before, the head portion of the reed baulk profile, with the sections C and D of the hollow space of it, are closed by end plates 52, which are integrally formed with the arms for the reciprocating motion of the reed baulk unit. On the left side of the reed baulk unit, where the main blowing nozzle 16 is situated, the closing end plate 52 is provided with connections for pressurized air (not shown in the drawing) connected to the sections C and D of the hollow space of the profile. The section C, from which the main blowing nozzle and the auxiliary blowing nozzle are supplied with air during normal operation of the machine, can be divided by a partition into two parts, viz. a part for supplying air to the main blowing nozzle and a part for supplying air to the auxiliary blowing nozzles. Such a partition, having its circumference adapted to the cross-sectional shape of the section C may be attached to the end plate 52 by means of spacers and may be provided with a sealing ring at its circumference. In this manner different air pressures may be used for the main blowing nozzle and the auxiliary blowing nozzles. If desired, more than one partitions may be applied in order to permit different working pressures to be used for different (groups of) auxiliary blowing nozzles. The longitudinal sections created by the partitions may be connected to the pressurized air source either through suitable through passages through the partitions or independent of each other.

The section D has been described before as an auxiliary container. The supply of pressurized air to this auxiliary container will be closed during normal operation of the machine and will be used only under special circumstances so as to effect the transportation of a weft through the shed when the machine is stopped to clear the machine by feeding the auxiliary blowing nozzles with pressurized air parallel to the normal air supply. For this purpose the auxiliary container D is connected by bores 53 to branches 54 of the above mentioned passages 42 (or connecting passages) toward the auxiliary blowing nozzles 44. In the branches 54 check valves 55 are provided, which are normally closed and will open only by the pressure within the auxiliary container D.

What we claim is:

1. A reed baulk unit for a pneumtic weaving machine comprising a series of reed blades held in a groove in a head portion of said unit and at least one blowing nozzle housing located close to said reed blades, said blowing nozzle housing being fed from a pressurized air container through valve means which are mounted on the reed baulk and adapted to be actuated by a control shaft supported by the reed baulk, said reed baulk having an arm portion by means of which it is fixed to rocking trunnions which are rotatably mounted in the weaving machine, said reed baulk unit being characterized in that the reed baulk is formed of an extruded hollow profile, a longitudinal hollow space of which serves as said pressurized air container communicating, through an opening in the wall of the reed baulk profile, with blowing nozzle housing located on the outer side of the reed baulk profile, and control valves for said blowing nozzle housing accommodated by the blowing nozzle housing, while said control shaft is supported in a substantially semi-cylindrical recess in a portion of the reed baulk profile projecting outwardly adjacent the blowing nozzle housing.

2. A unit according to claim 1, characterized in that the reed baulk and the arm portion and integrally formed as a hollow profile having a longitudinally constant cross-section, said profile having at its longitudinal edge turned away from the reed blades a substantially semi-cylindrical recess extending along the entire length of the profile and adapted to accommodate the rocking trunnions.

3. A unit according to claim 1, characterized in that the longitudinal hollow space of the reed baulk serving as the pressurized air container is closed at the ends by plates.

4. A unit according to claim 3, characterized in that at least one of the closing end plates is connected, by spacers, to one or more walls, which are slidably mounted in the longitudinal hollow space and has its circumference adapted to the cross-sectional form of said hollow space.

5. A unit according to claim 1, characterized in that the longitudinal hollow space of the reed baulk profile serving as a container for pressurized air comprises at least two longitudinal sections, one of which is directly connected to the blowing nozzle housing, whereas the second section constitutes an auxiliary container.

6. A reed baulk according to claim 1, characterized by an extruded profile, comprising a bending resistant section having a longitudinal hollow space closed on all sides and a second section which is connected to said first section by means of a reduced portion and hence may be bent relative to said profile section, said two sections defining a groove for accommodating said reed blades, a side wall portion of the bending resistant section adjacent the groove being provided with a longitudinally extending projection having a substantially semi-cylindrical recess.

7. A reed baulk according to claim 6, characterized in that the longitudinal hollow space is divided, by a longitudinally extending partition, into two sections.

* * * * *